US010771895B2

(12) United States Patent
Hosoya et al.

(10) Patent No.: US 10,771,895 B2
(45) Date of Patent: Sep. 8, 2020

(54) AUDIO SIGNAL PROCESSING DEVICE

(71) Applicant: MITSUBISHI ELECTRIC CORPORATION, Tokyo (JP)

(72) Inventors: Kosuke Hosoya, Tokyo (JP); Masaru Kimura, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/484,258

(22) PCT Filed: Mar. 14, 2017

(86) PCT No.: PCT/JP2017/010074
§ 371 (c)(1),
(2) Date: Aug. 7, 2019

(87) PCT Pub. No.: WO2018/167834
PCT Pub. Date: Sep. 20, 2018

(65) Prior Publication Data

US 2020/0007982 A1 Jan. 2, 2020

(51) Int. Cl.
*H04R 3/02* (2006.01)
*H04R 3/04* (2006.01)
*H04R 29/00* (2006.01)

(52) U.S. Cl.
CPC ..... *H04R 3/02* (2013.01); *H04R 3/04* (2013.01); *H04R 29/001* (2013.01)

(58) Field of Classification Search
CPC ..... H04R 3/02; H04R 29/001; H04R 3/04
USPC ..... 381/59, 55, 89, 96, 103
See application file for complete search history.

(56) References Cited

U.S. PATENT DOCUMENTS

2012/0179456 A1* 7/2012 Ryu ..... H04R 3/007 704/200.1
2014/0321668 A1* 10/2014 Kimura ..... H04R 3/04 381/101
2015/0030181 A1* 1/2015 Kimura ..... H04R 3/04 381/94.3

FOREIGN PATENT DOCUMENTS

JP 2014-506076 A 3/2014
JP 6038135 B2 12/2016
WO WO 2013/183185 A1 12/2013

OTHER PUBLICATIONS

International Search Report, issued in PCT/JP2017/010074, PCT/ISA/210, dated May 9, 2017.

* cited by examiner

*Primary Examiner* — Melur Ramakrishnaiah
(74) *Attorney, Agent, or Firm* — Birch, Stewart, Kolasch & Birch, LLP.

(57) ABSTRACT

An audio signal processing device includes a high pass filter to convert an input audio signal into a first audio signal and to output the first audio signal, a displacement estimation unit to estimate displacement amplitude of a speaker diaphragm when the input audio signal is inputted, a saturation processing unit to perform saturation processing to the displacement amplitude estimated in the displacement estimation unit or to a signal obtained by correcting the displacement amplitude, an audio signal generation unit to generate a second audio signal by using displacement amplitude obtained after the saturation processing in the saturation processing unit, and an output generation unit to generate an output signal by using the first and the second audio signals. With this configuration, a cracking sound of a speaker is reduced and a user is allowed to feel low frequency components.

12 Claims, 9 Drawing Sheets

AUDIO SIGNAL PROCESSING DEVICE

TECHNICAL FIELD

The present invention relates to an audio signal processing device to perform signal processing of an audio signal.

BACKGROUND ART

In an audio reproduction system in which a speaker reproduces sound signals such as music and an announce sound, sound distortion or cracking sound may occur owing to the input signal exceeding a reproduction limit of the speaker, and the sound quality may be deteriorated. This will be described in detail below.

In the reproduction using a speaker, since a diaphragm of the speaker is allowed to vibrate within its maximum displacement amplitude, when a signal causing the diaphragm displacement to exceed the maximum displacement amplitude is inputted, the speaker diaphragm cannot vibrate properly, so that sound distortion and cracking sound occur. The displacement amplitude of a speaker diaphragm depends on the frequency of an input signal. This relation is shown in FIG. 8. FIG. 8 is a schematic graph showing the displacement amplitude of a speaker diaphragm when a signal is inputted to a speaker under the condition that only the frequency of the signal is changed with the voltage (V) kept constant. In reality, however, the speaker's characteristic around the minimum resonance frequency F0 may be somewhat different from that in FIG. 8, depending on the Q factor, etc. indicating the extent of the damping of the speaker. But, roughly speaking, the characteristic is the same. Further, it is noted that the present invention can be applied even to a speaker whose displacement amplitude characteristic is different from that shown in FIG. 8. However, for convenience of description, the characteristic shown in FIG. 8 will be used as an example.

As shown in FIG. 8, the displacement amplitude of the speaker diaphragm is substantially constant at frequencies below F0 and decreases with a slope of approximately −12 dB/oct at frequencies above F0. This indicates that the speaker diaphragm vibrates with much displacement amplitude when a frequency lower than around F0 is inputted to the speaker when compared with a case where a higher frequency is inputted to the speaker. Thus, when a signal including many low frequency components is inputted to the speaker and the voltage of the signal is increased, the maximum displacement amplitude of the diaphragm is exceeded at a voltage equal to or larger than a certain voltage. In other words, the reproduction limit of the speaker is more easily exceeded when the more the signal includes lower frequencies and the higher the voltage is increased. This situation is shown in FIG. 9.

In FIG. 9, the vertical axis represents the amplitude of a signal and the horizontal axis represents the frequency. Further, the gray pattern region represents a region where the cracking sound occurs because a displacement limit of the speaker diaphragm is exceeded, and the boundary is indicated by the bold line. Here, the characteristics shown in FIG. 9 are characteristics of audio signals with respect to amplitude values, and unlike the characteristic of the displacement amplitude of the speaker shown in FIG. 8, the displacement limit of the speaker diaphragm is represented by the slope of +12 dB/oct.

In addition, 901, 902, and 903 represent frequency characteristics of audio signals to be reproduced by the speaker, and in particular, cases are assumed where the signals include many low frequency components. Here, 901 is the characteristic at a low sound volume value, 902 is the characteristic at a medium sound volume value, and 903 is the frequency characteristic at a high sound volume value. When a reproduction is performed at the low sound volume value as in 901, the displacement limit of the speaker diaphragm is not exceeded even with the audio signal including many low frequency components, so that the cracking sound does not occur and the original quality sound can be enjoyed. Under an increased sound volume as in 902 and 903, however, the cracking sound occurs and the sound quality degrades because the displacement limit of the speaker diaphragm is exceeded.

As described above, when a signal exceeding the maximum displacement amplitude of the diaphragm is inputted, the speaker diaphragm cannot properly vibrate, and thus the cracking sound occurs.

Patent Document 1 discloses a conventional technique to reduce the cracking sound of a speaker. In Patent Document 1, an excessive input estimation unit, a control unit, and a frequency characteristic transformation unit are provided, and it is estimated that an audio signal for the reproduction leads to an excessive input, and then a variable filter is controlled in accordance with the estimation result to prevent the cracking sound of a speaker.

PRIOR ART DOCUMENT

Patent Document

Patent Document 1: Japanese Patent No. 6038135

SUMMARY OF THE INVENTION

Problems to be Solved by the Invention

The conventional technique disclosed in Patent Document 1 mentioned above requires some amount of calculation because a variable filter is used. In addition, a problem arises in that, when the audio signal that is processed to reduce low frequency components are reproduced by a speaker, the sound lacks powerfulness.

The present invention is devised to solve the problems described above and to provide an audio signal processing device as well as a method with which a user aurally feels low frequency components while the cracking sound of a speaker is reduced with a small calculation amount.

Means for Solving the Problems

An audio signal processing device according to the present invention includes a high pass filter to convert an input audio signal into a first audio signal and to output the first audio signal, a displacement estimation unit to estimate displacement amplitude of a speaker diaphragm when the input audio signal is inputted, a saturation processing unit to perform saturation processing to the displacement amplitude estimated in the displacement estimation unit or to a signal obtained by correcting the displacement amplitude, an audio signal generation unit to generate a second audio signal by using the displacement amplitude after the saturation processing in the saturation processing unit, and an audio signal synthesizing unit to synthesize the first audio signal and the second audio signal.

Effects of the Invention

The audio signal processing device according to the present invention can reduce the cracking sound of a speaker and, at the same time, it is possible for a user to feel low frequency components, when compared with the conventional technique.

EMBODIMENTS FOR CARRYING OUT THE INVENTION

Embodiment 1

Figure 1:
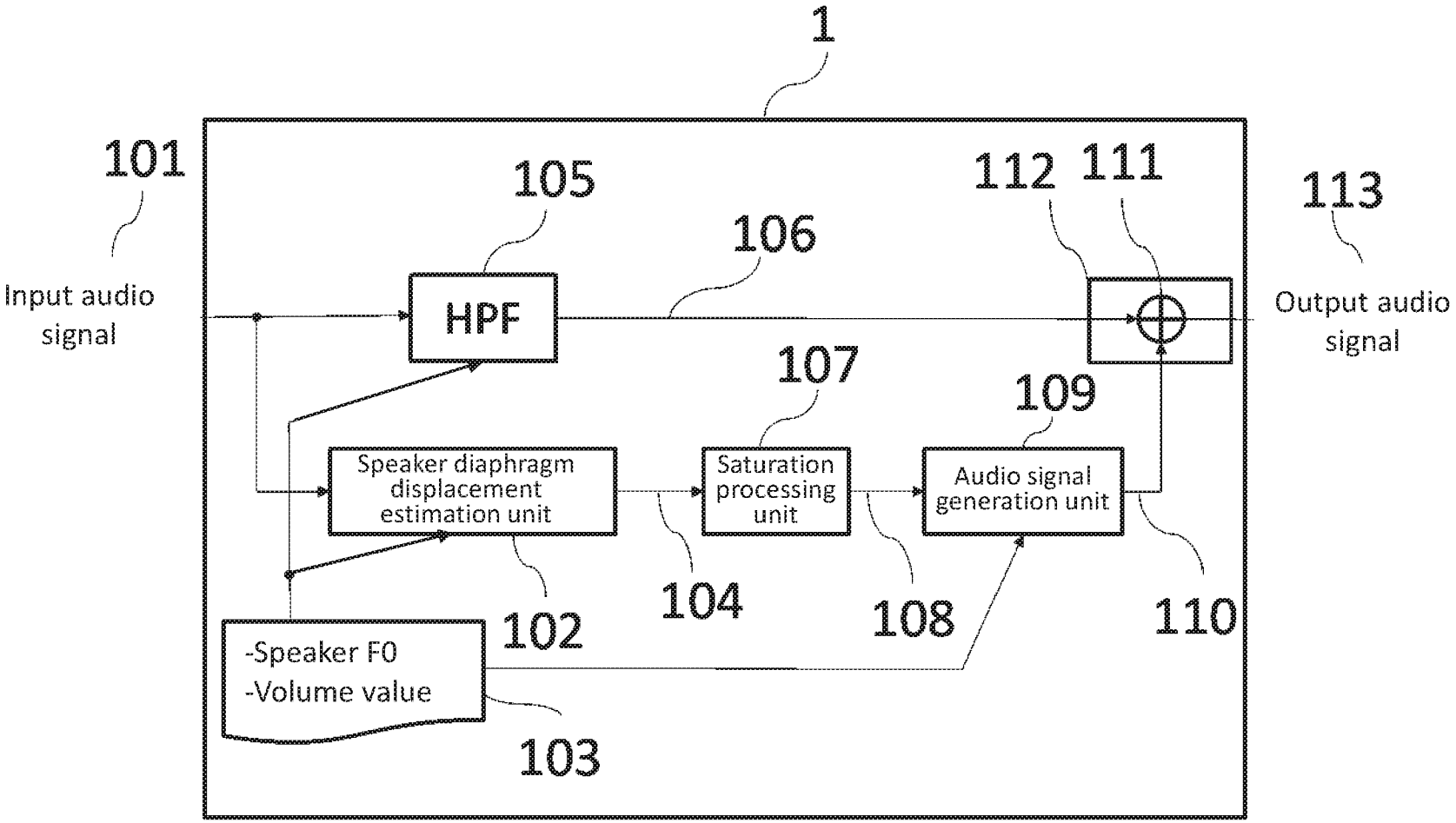
FIG. 1 is a configuration diagram showing an audio signal processing device 1 according to Embodiment 1 of the present invention.

Embodiments of the present invention will be described below. FIG. 1 is a diagram showing an entire configuration of an audio signal processing device 1 according to the present embodiment that generates an audio signal to be reproduced by a speaker. Note that, in each of the following figures, the same numerals indicate the same or equivalent components.

In the audio signal processing device 1 according to Embodiment 1 of the present invention, an input audio signal 101 that is inputted branches off and is transmitted both to a speaker diaphragm displacement estimation unit 102 and a high pass filter (HPF) 105. The speaker diaphragm displacement estimation unit 102 estimates the displacement amplitude of the speaker diaphragm when the input audio signal 101 is reproduced, and then outputs estimated speaker diaphragm displacement amplitude 104 to a saturation processing unit 107. The HPF 105 is a high pass filter to attenuate input signal components in frequencies lower than a cutoff frequency with an attenuation factor larger than that for frequencies higher than the cutoff frequency. The HPF 105 outputs to an output generation unit 112, a HPF audio signal 106 obtained by filtering processing on the input audio signal 101.

Using information 103 on a volume value and a minimum resonance frequency F0 of a target speaker, the speaker diaphragm displacement estimation unit 102 estimates displacement amplitude of the speaker diaphragm when the input audio signal 101 is reproduced and outputs the estimated speaker diaphragm displacement amplitude 104. As mentioned above, the displacement amplitude of a speaker diaphragm is substantially constant at frequencies lower than F0 of the speaker and decreases with a slope of approximately −12 dB/oct at frequencies higher than F0 of the speaker. Therefore, specifically for the estimation of the displacement amplitude, an LPF (Low Pass Filter) based on a second-order infinite impulse response (IIR) filter with the cutoff frequency F0 is prepared and applied to the input signal, and then multiplying the volume value results in a value substantially proportional to the displacement amplitude of the target speaker. Note that, the displacement characteristic of the target speaker diaphragm may be estimated by using another means such as a finite impulse filter (FIR). The estimated speaker diaphragm displacement amplitude 104 obtained by such a method is outputted to the saturation processing unit 107.

The HPF 105 outputs to the output generation unit 112, the HPF audio signal 106 obtained by filtering processing on the input audio signal 101. The frequency characteristic of the filter used in the HPF 105 is designed in such a manner that the resultant gain after the gain in the frequency characteristic of the LPF used in the speaker diaphragm displacement estimation unit 102 is added together in the frequency domain is one throughout the frequency range. To be more specific, when an LPF based on a second-order IIR filter with its cutoff frequency being F0 is used in the speaker diaphragm displacement estimation unit 102, a HPF based on a second-order IIR filter with its cutoff frequency being F0 is used in the HPF 105. Further, when a FIR filter is used in the speaker diaphragm displacement estimation unit 102, a HPF of the same number of taps is used in the HPF 105.

Figure 2:
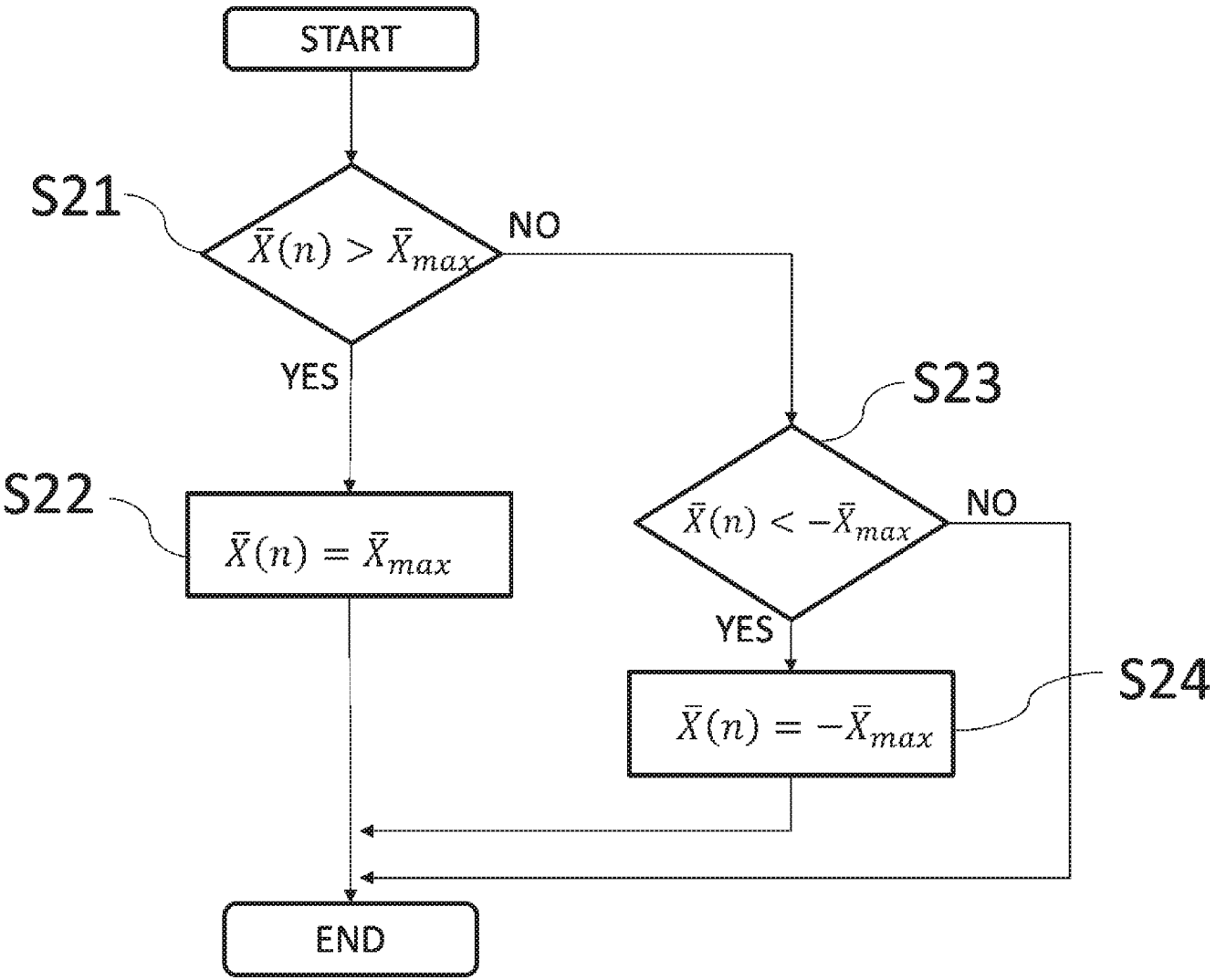
FIG. 2 is a flow chart showing an operation of a saturation processing unit 107 of the present invention.

The saturation processing unit 107 performs to the estimated speaker diaphragm displacement amplitude 104, a limiter processing with a threshold value equal to a displacement limit of the speaker diaphragm and outputs to an audio signal generation unit 109, estimated speaker diaphragm displacement amplitude after saturation processing 108. A specific processing flow chart is shown in FIG. 2. Here, $\overline{X}(n)$ denotes the estimated speaker diaphragm displacement amplitude 104 and $\overline{X}max$ denotes a displacement limit of a speaker diaphragm. When the estimated speaker diaphragm displacement amplitude 104: $\overline{X}(n)$ is larger than the displacement limit of the speaker diaphragm: $\overline{X}max$ in S21, then let $\overline{X}(n)=\overline{X}max$ (S22). In contrast, when the estimated speaker diaphragm displacement amplitude 104: $\overline{X}(n)$ is smaller than the displacement limit of the speaker diaphragm: $\overline{X}max$ in S21, and, when $\overline{X}(n)$ is smaller than $\overline{X}max$ in S23, then let $\overline{X}(n)=\overline{X}max$ (S24). In the other case, the estimated speaker diaphragm displacement amplitude 104: $\overline{X}(n)$, being left intact, is the estimated speaker diaphragm displacement amplitude after saturation processing 108. With the saturation processing performed, when the signal after the saturation processing is reproduced by the target speaker, the displacement limit is not exceeded. Furthermore, as a result of the saturation processing, the waveform is distorted and harmonics are generated. However, listening the sound including harmonics allows a user aurally to feel low frequency components. In other words, by performing the saturation processing, even if the low frequency components are reduced, it is possible for the user to feel the low frequency components. Thus, both making the user feel the low frequency components and reducing the cracking sound of a speaker can be made possible.

The audio signal generation unit 109 converts into an audio signal, the estimated speaker diaphragm displacement amplitude after saturation processing 108 by using the information 103 on the volume value and F0 of the target speaker and outputs to the output generation unit 112, a converted audio signal 110. To be more specific, the estimated speaker diaphragm displacement amplitude after saturation processing 108 is divided by the volume value in the information 103 on the volume value and the target speaker's F0. Through this processing, the estimated speaker diaphragm displacement amplitude after saturation processing 108 can be converted into an audio signal.

The output generation unit 112 generates a final output by using the HPF audio signal 106 obtained in the HPF 105 and the converted audio signal 110 obtained in the audio signal generation unit 109 and outputs an output audio signal 113. Here, for a concrete example, a case in which the output generation unit 112 includes an audio signal synthesizing unit 111 will be described. The audio signal synthesizing unit 111 provided in the output generation unit 112 adds the HPF audio signal 106 and the audio signal 110 to generate the final output.

Figure 3:
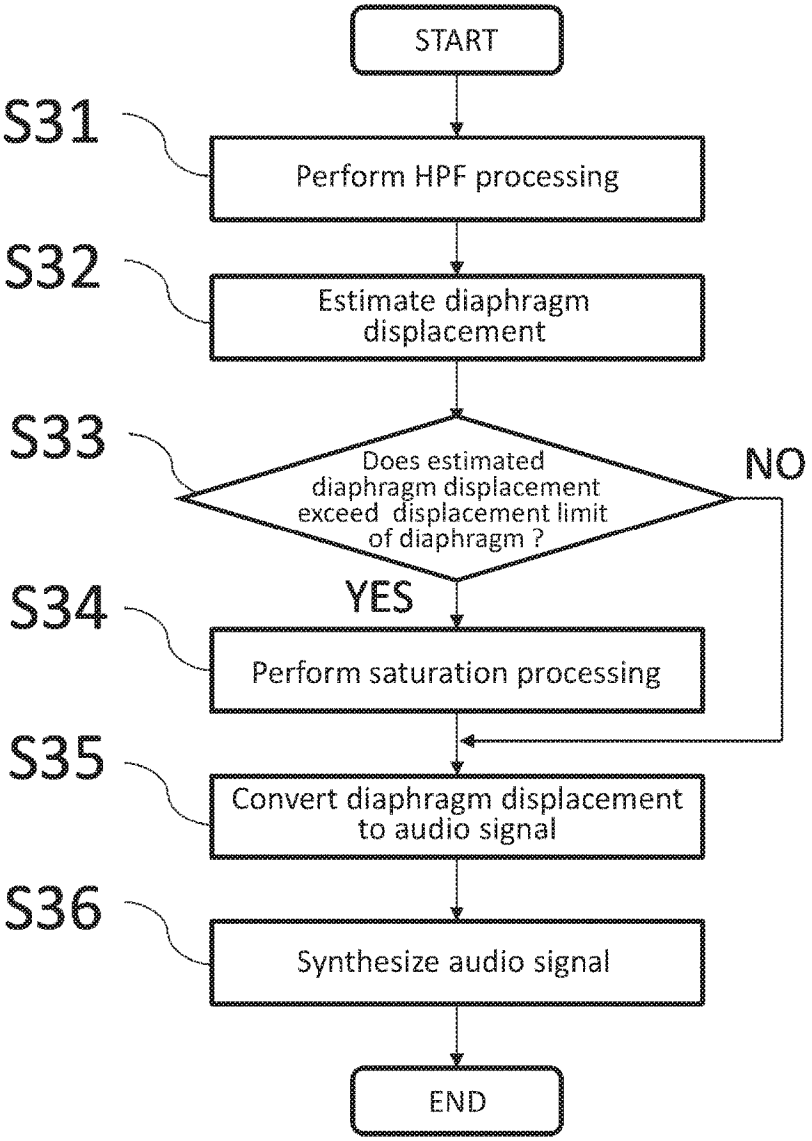
FIG. 3 is a flow chart showing an operation of the audio signal processing device 1 according to Embodiment 1 of the present invention.

FIG. 3 is a flow chart showing a processing flow of the present embodiment. The audio signal processing device 1 according to the present invention performs high-pass filtering to the input audio signal 101 in the HPF 105 (S31). Using the information 103 on the volume value and the minimum resonance frequency F0 of the target speaker, the speaker diaphragm displacement estimation unit 102 estimates the displacement amplitude of the speaker diaphragm when the input audio signal 101 is reproduced, and then outputs the estimated speaker diaphragm displacement amplitude 104 (S32). When the estimated speaker diaphragm displacement amplitude 104 exceeds the displacement limit of the diaphragm in S33, the saturation processing unit 107 performs saturation processing (S34). Further, the audio signal generation unit 109 converts the estimated speaker diaphragm displacement amplitude after saturation processing 108 into the audio signal by using the information 103 on the volume value and the target speaker's F0 (S35). The audio signal synthesizing unit 111 synthesizes the HPF audio signal 106 obtained in the HPF 105 with the converted audio signal 110 obtained in the audio signal generation unit 109, and then outputs audio signal 113 (S36).

Figure 4:
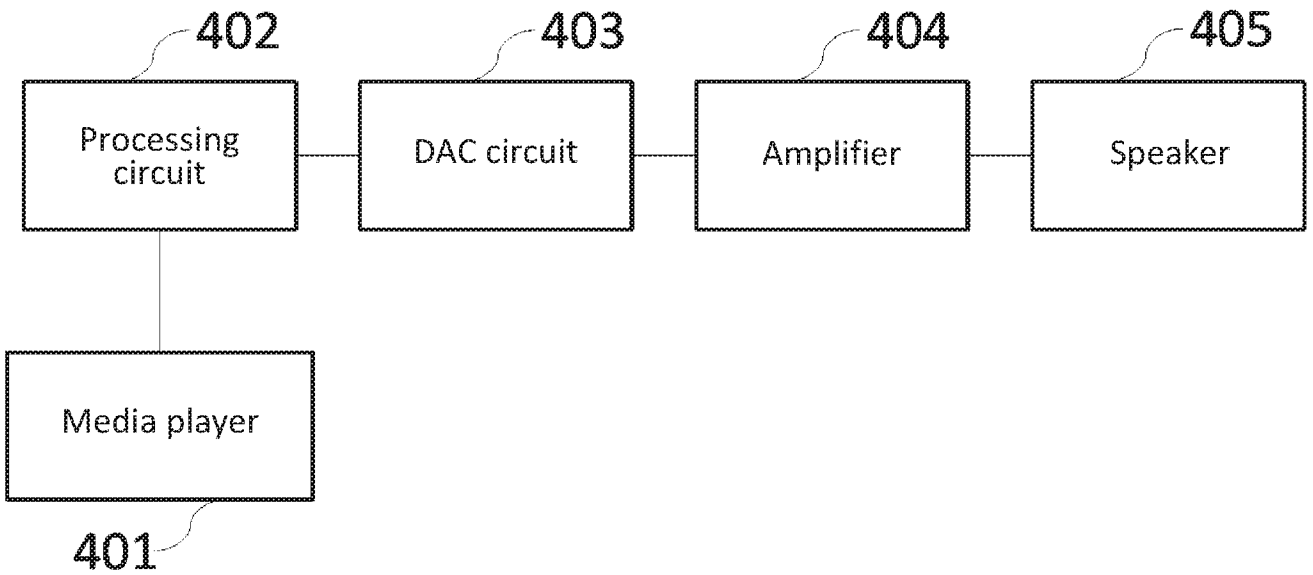
FIG. 4 is a H/W configuration diagram of the audio signal processing device 1 according to Embodiment 1 of the present invention.
Figure 5:
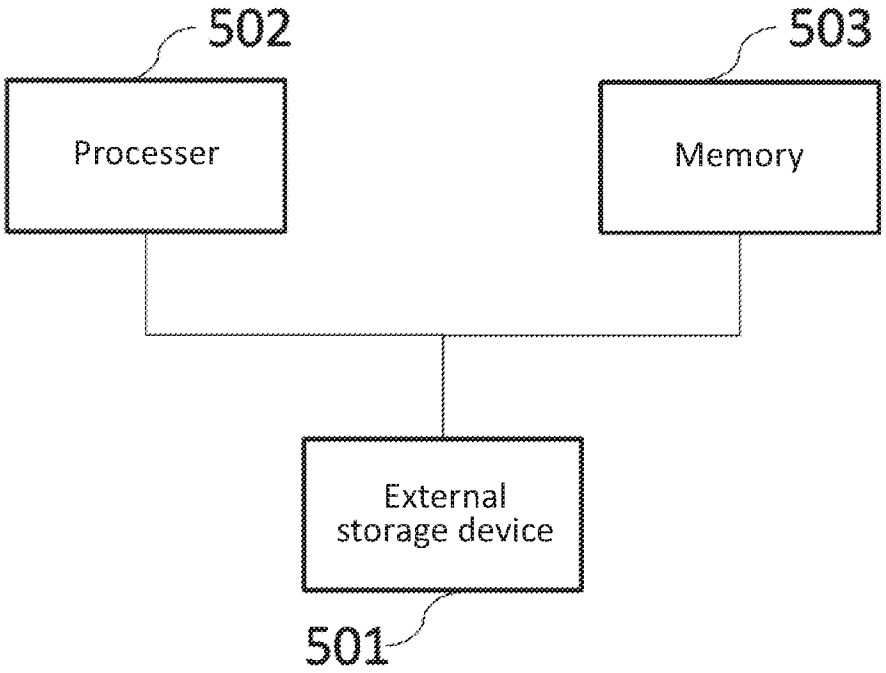
FIG. 5 is a H/W configuration diagram in a case where functions of the audio signal processing device 1 according to Embodiment 1 of the present invention are implemented by S/W.

The audio signal processing device 1 of the present invention may be made possible either by hardware (H/W) or by software (S/W). A configuration thereof implemented by H/W is shown in FIG. 4, and a configuration thereof implemented via S/W is shown in FIG. 5. In the H/W configuration, the audio signal is inputted from a media player 401 and a processing circuit 402 processes the audio signal, and then a digital-to-analog conversion (DAC) circuit 403 converts the processed audio signal into an analog signal that is transferred to a speaker 405 via an amplifier 404. The media player 401 here corresponds to a device that reads digital information from a media such as a compact disc (CD), a digital versatile disc (DVD), and a blu-ray disc (BD). In the S/W configuration, a processor 502 reads out data stored in an external storage device 501 and processes the audio signal on the basis of a program stored in a memory 503. The processed audio signal is stored again in the external storage device 501. Note that, the external storage device 501 corresponds to a storage device such as a hard disk drive (HDD) or a solid state drive (SSD) that is connected to the audio signal processing device 1 directly or through a network.

As described so far, the processing configuration according to Embodiment 1 can prevent the reproduced audio signal from being an excessive input. In addition, harmonics can be generated through saturation processing. Therefore, according to the present invention, an effect is such that the cracking sound of a speaker is reduced and a user is allowed to feel low frequency components. Furthermore, all of the filters used in the present embodiment are fixed filters, and thus an effect is such that processing is made possible with a small amount of calculation.

As can be seen above, the audio signal processing device according to Embodiment 1 includes the HPF 105 to convert the input audio signal 101 into the HPF audio signal 106 being a first audio signal and to output the first audio signal, a speaker diaphragm displacement estimation unit 102 being a displacement estimation unit to estimate the displacement amplitude of a speaker diaphragm when the input audio signal 101 is inputted, the saturation processing unit 107 to perform saturation processing to the displacement amplitude estimated in the displacement estimation unit 102, the audio signal generation unit 109 to generate the audio signal 110 being a second audio signal by using the displacement amplitude after the saturation processing in the saturation processing unit 107, and the output generation unit 112 to generate an output signal by using the first and the second audio signals. With the configuration described above, the effect is such that the cracking sound of a speaker is reduced and a user is allowed to feel low frequency components in comparison with the conventional technique. Furthermore, all of the filters used in the present embodiment are fixed filters, and thus an effect is such that processing is made possible with a small amount of calculation.

Further, in the audio signal processing device 1 according to Embodiment 1, the output generation unit 112 is characterized in outputting a signal obtained by synthesizing the first audio signal with the second audio signal. With this processing configuration, the cracking sound of a speaker can be reduced and the audio signal that allows a user to feel low frequency components can be outputted with a small amount of calculation.

In addition, in the audio signal processing device 1 according to Embodiment 1, the speaker diaphragm displacement estimation unit 102 is characterized in estimating the displacement amplitude of the speaker diaphragm by using the resonance frequency of the speaker that reproduces the input audio signal or the volume information. With this processing configuration, the displacement amplitude of the speaker diaphragm can be estimated with high accuracy and the cracking sound of the speaker can be reliably reduced.

Embodiment 2

The present embodiment, as a variation of Embodiment 1, shows that harmonics generated in the saturation processing unit 107 are adjusted in accordance with the preference of a user by the audio signal processing device 1 in which a user setting value 601, a harmonics controlling unit 602, and a frequency characteristic adjusting unit 605 are further included.

Figure 6:
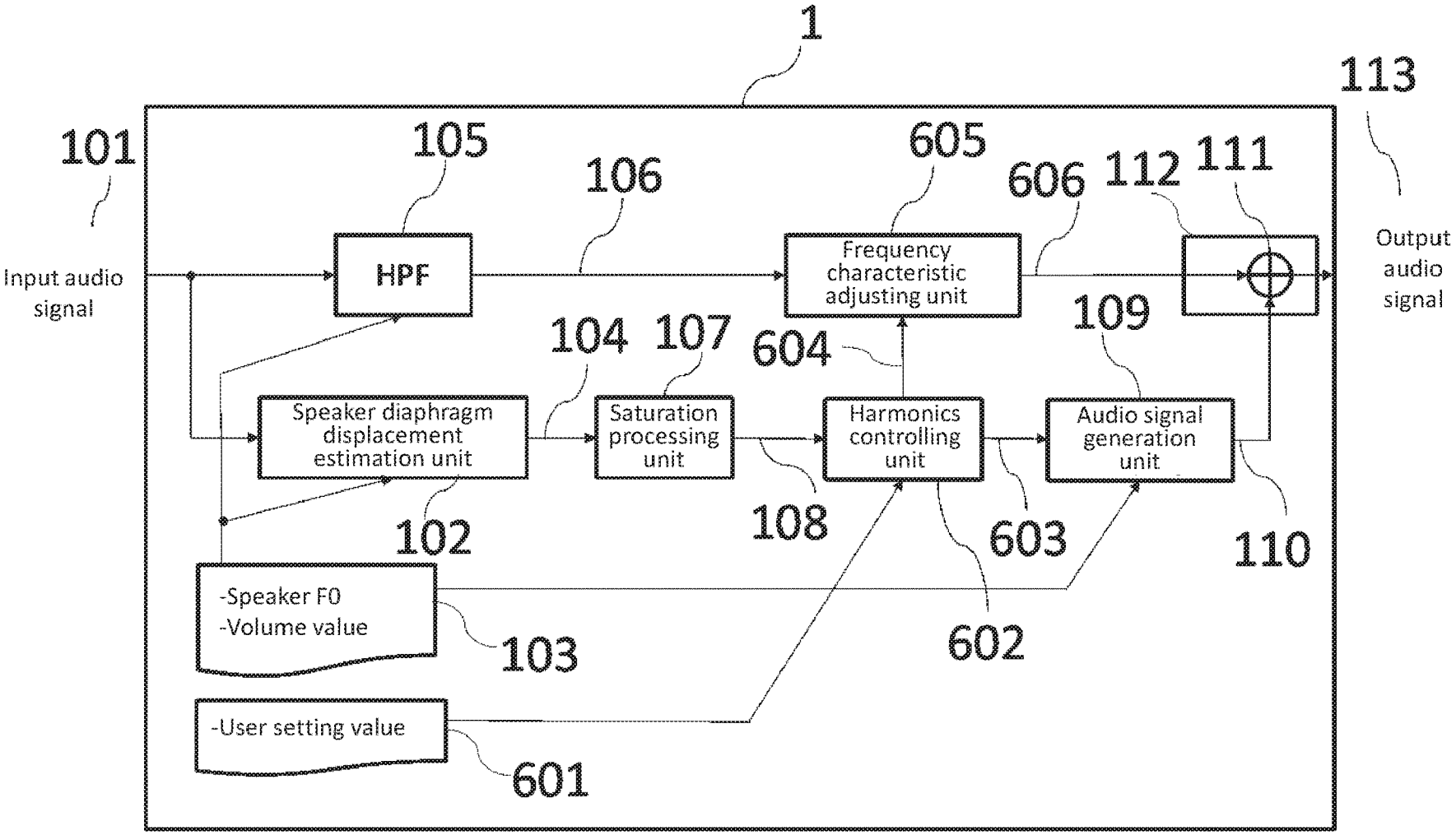
FIG. 6 is a configuration diagram showing an audio signal processing device 1 according to Embodiment 2 of the present invention.

FIG. 6 shows an entire configuration of an audio signal processing device 1 according to the present embodiment. As those different from FIG. 1, new components including the user setting value 601, the harmonics controlling unit 602, a frequency characteristic adjusting unit 605, and an audio signal with an adjusted frequency characteristic 606 are added. All the other components are the same as in Embodiment 1.

The harmonics controlling unit 602 receives the user setting value 601 and the estimated speaker diaphragm displacement amplitude after saturation processing 108, reduces the higher components of the harmonics generated in the saturation processing unit 107 by changing parameters in the LPF in accordance with the user setting value 601, and outputs to the audio signal generation unit 109, estimated speaker diaphragm displacement amplitude after harmonics control 603. Further, LPF parameter information 604 used for the harmonics control is outputted to the frequency characteristic adjusting unit 605. Here, in the case of an IIR-type filter, the LPF parameter information includes information such as a Q factor, a cutoff frequency, and the number of orders, whereas in the case of an FIR-type filter, it includes information such as a cutoff frequency and the number of taps. In addition, the frequency characteristic of the LPF to be changed in accordance with the user setting value 601 may be either or both of the cutoff frequency and the attenuation characteristic.

The frequency characteristic adjusting unit 605 receives the HPF audio signal 106, and the LPF parameter information 604 used for the harmonics control, performs filtering processing, and outputs to the audio signal adding unit 111, the audio signal 606 with the frequency characteristic adjusted. The frequency characteristic of the filter used in the frequency characteristic adjusting unit 605 is designed in such a manner that resultant gain after the gain in the frequency characteristic of the LPF used in the harmonics controlling unit 602 is added together in the frequency domain is one throughout the frequency range. To be more specific, if a LPF of a second-order IIR type is used in the harmonics controlling unit 602, a HPF of a second-order IIR type having the same cutoff frequency and the same Q factor as those in the LPF needs to be used in the frequency characteristic adjusting unit 605. In addition, if a FIR filter is used as a LPF in the harmonics controlling unit 602, a HPF having the same number of taps needs to be used in the frequency characteristic adjusting unit 605.

As described above, according to the present embodiment, the harmonics generated in the saturation processing can be controlled in accordance with the user setting value, and thus an effect is such that the low frequency components aurally felt can be adjusted in accordance with the preference of a user.

As can be seen above, the audio signal processing device according to Embodiment 2 further includes the frequency characteristic adjusting unit 605 to generate a signal adjusted from the first audio signal, and the harmonics controlling unit 602 to control the frequency characteristic of the harmonics generated by the saturation processing of the displacement amplitude in the saturation processing unit 107, wherein the audio signal generation unit 109 generates the audio signal 110 being the second audio signal by using the signal controlled in the harmonics controlling unit 602 and the output generation unit 112 outputs a signal obtained by synthesizing the second audio signal with the signal obtained by adjusting the first audio signal. With this processing configuration, the effect is such that the low frequency components aurally felt can be adjusted in accordance with the preference of a user.

Furthermore, the audio signal processing device 1 according to Embodiment 2 is characterized in that the sum of the gain in the frequency characteristic to be used for the adjustment in the frequency characteristic adjusting unit 605 and the gain in the frequency characteristic to be used for the control in the harmonics controlling unit 602 in the frequency domain is constant or one, throughout the frequency range where the input audio signal 101 exists. With this processing configuration, the effect is such that the low frequency components aurally felt can be adjusted in accordance with the preference of a user while the basic characteristic is kept in the frequency characteristic of the audio signal.

Embodiment 3

In the present embodiment, a Q factor correction unit 702 and a Q factor inverse correction unit 704 are further included in addition to the configuration of Embodiment 2, and thus the displacement amplitude of the speaker diaphragm can be estimated with high accuracy in a case where the Q factor of the target speaker is known.

Figure 7:
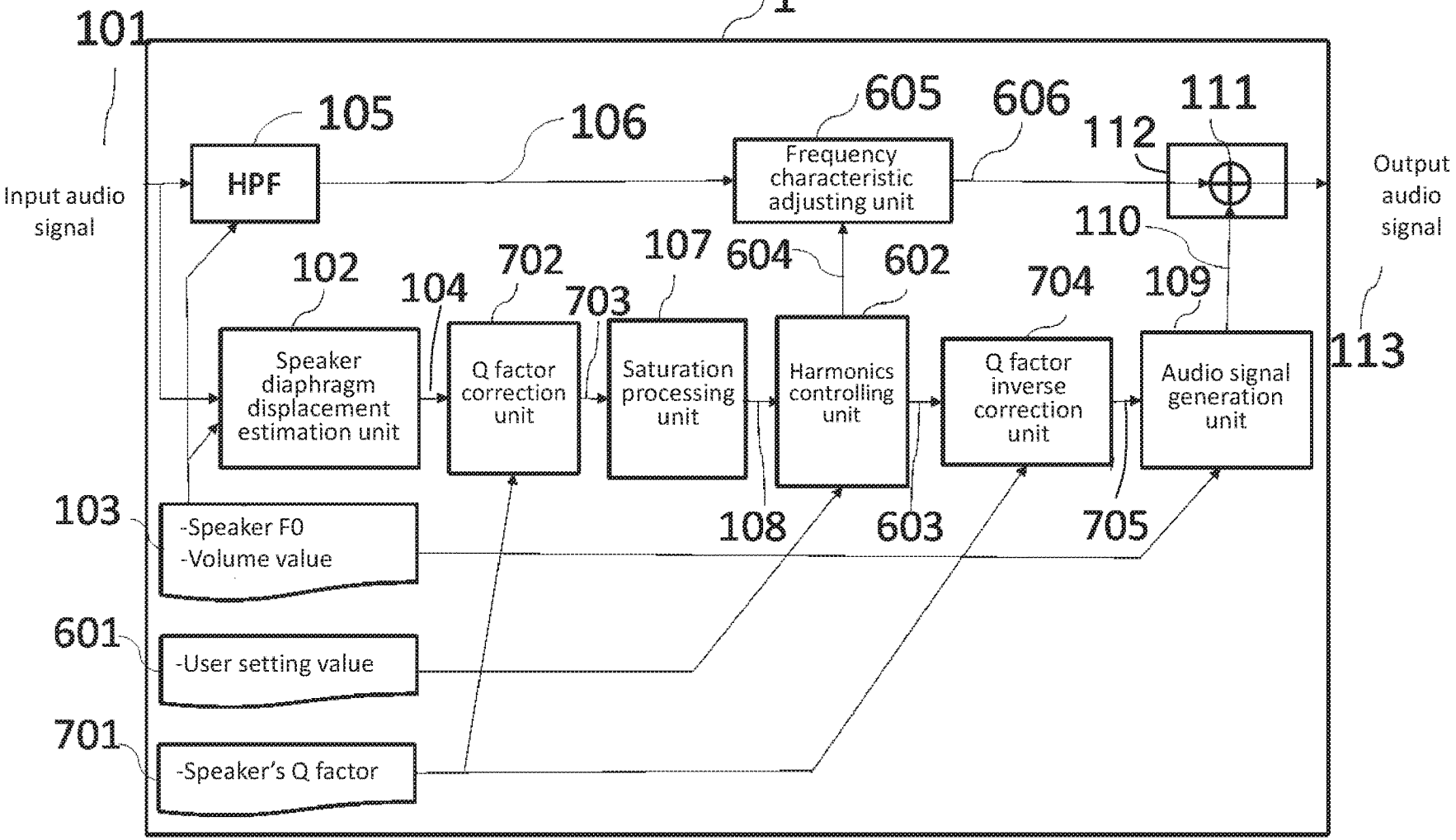
FIG. 7 is a configuration diagram showing an audio signal processing device 1 according to Embodiment 3 of the present invention.
Figure 8:
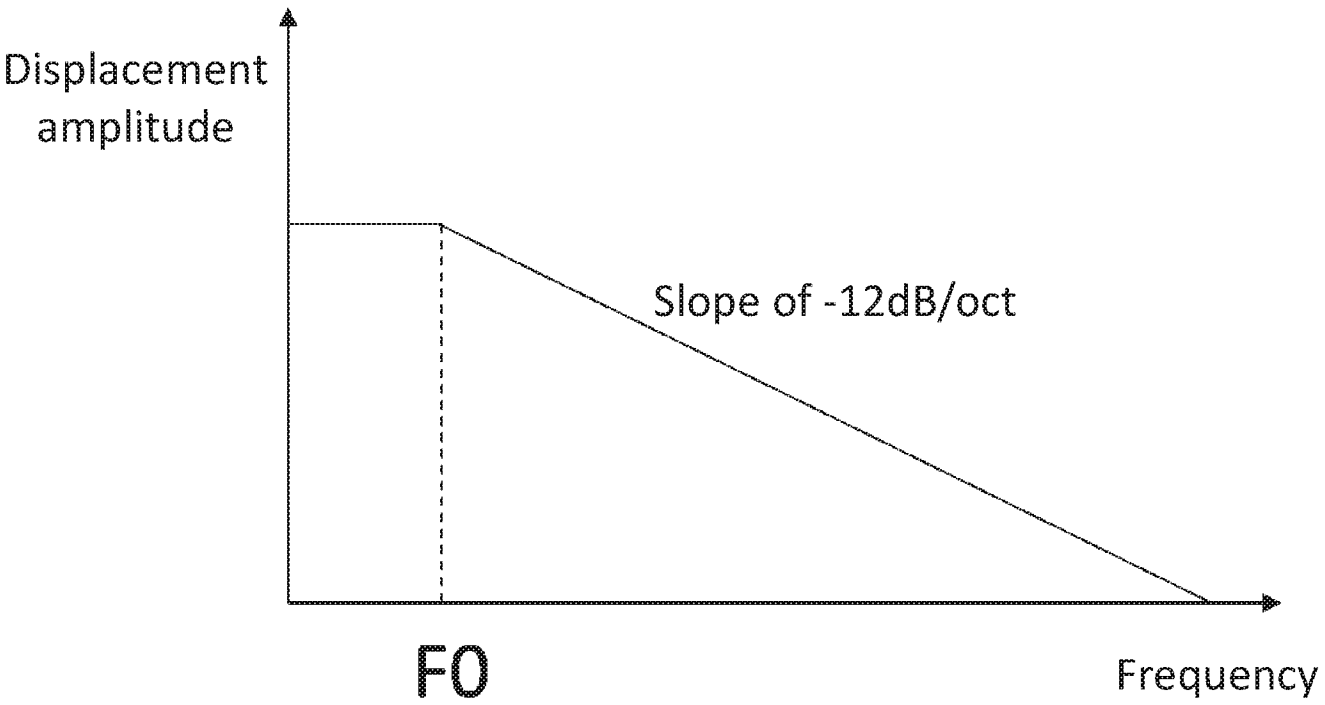
FIG. 8 is a schematic graph showing a displacement characteristic of a speaker diaphragm.
Figure 9:
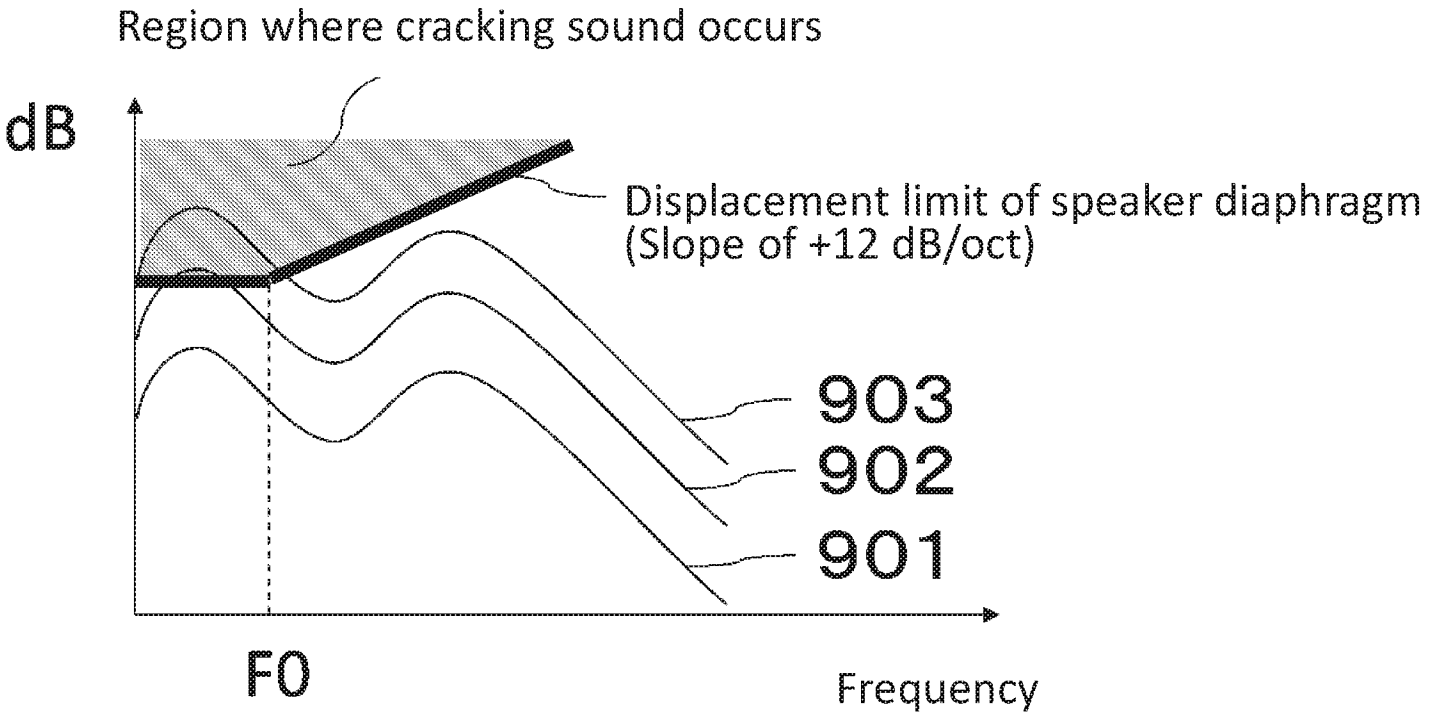
FIG. 9 is a schematic graph showing a relation between a displacement limit of a speaker diaphragm and frequency characteristics of sound sources.

FIG. 7 shows an entire configuration of an audio signal processing device 1 according to the present embodiment. As those different from FIG. 6, new components including a speaker Q factor 701, a Q factor correction unit 702, estimated speaker diaphragm displacement amplitude after Q factor correction 703, a Q factor inverse correction unit 704, and estimated speaker diaphragm displacement amplitude after Q factor inverse correction 705 are added. All the other components are the same as in Embodiment 2.

The Q factor correction unit 702 receives the speaker Q factor 701 and the estimated speaker diaphragm displacement amplitude 104, performs correction processing to the difference between the filter Q factor used in the speaker diaphragm displacement estimation unit 102 and the speaker Q factor, and outputs to the saturation processing unit 107, the estimated speaker diaphragm displacement amplitude after Q factor correction 703. As for a concrete Q factor correction method, for example, in the case of an underdamped speaker whose Q factor is higher than the critical value ½ as the Q factor correction, the amplitude level at the frequency around F0 may be increased by using a peaking equalizer of a second-order IIR type or the like.

The Q factor inverse correction unit 704 receives the speaker Q factor 701 and the estimated speaker diaphragm displacement amplitude after harmonics control 603, performs correction by using a filter having a frequency characteristic inverse to that of the Q factor correction unit, and outputs to the audio signal generation unit 109, the estimated speaker diaphragm displacement amplitude after Q factor inverse correction 705. Specifically as for a feasible method, for example, in the case where a peaking equalizer of a second-order IIR type that amplifies the amplitude level by 6 dB with F0 as the center frequency is used in the Q factor correction unit 702, a peaking equalizer of a second-order IIR type that attenuates the amplitude level by 6 dB with F0 as the center frequency is used in the Q factor inverse correction unit 704.

As so far described above, in accordance with the present embodiment, the displacement amplitude of a speaker diaphragm can be estimated with higher accuracy by correcting the Q factor.

As can be seen above, the audio signal processing device 1 according to Embodiment 3 further includes the Q factor correction unit 702 being a correction unit to correct the displacement amplitude estimated in the speaker diaphragm displacement estimation unit 102 being the displacement estimation unit by using a Q factor of the speaker that reproduces the input audio signal, thereby generating a signal obtained by correcting the displacement amplitude; and the Q factor inverse correction unit 704 to correct the signal controlled in the harmonics controlling unit 602 by using the frequency characteristic inverse to that for the correction performed in the Q factor correction unit 702, wherein the audio signal generation unit 109 generates the audio signal 110 being the second audio signal by using the signal corrected in the Q factor inverse correction unit 704. With this processing configuration, the effect obtained is such that the displacement of a speaker diaphragm can be estimated with higher accuracy.

DESCRIPTION OF SYMBOLS

1: audio signal processing device
101: input audio signal
102: speaker diaphragm displacement estimation unit
103: information on volume value and F0 of target speaker
104: estimated speaker diaphragm displacement amplitude
105: HPF
106: HPF audio signal
107: saturation processing unit
108: estimated speaker diaphragm displacement amplitude after saturation processing
109: audio signal generation unit
110: converted audio signal
111: audio signal synthesizing unit
112: output generation unit
113: output audio signal
401: media player
402: processing circuit
403: DAC circuit
404: amplifier
405: speaker
501: external storage device
502: processor
503: memory
601: user setting value
602: harmonics controlling unit
603: estimated speaker diaphragm displacement amplitude after harmonics control
604: LPF parameter information used for harmonics control
605: frequency characteristic adjusting unit
606: audio signal with adjusted frequency characteristic
701: speaker Q factor
702: Q factor correction unit
703: estimated speaker diaphragm displacement amplitude after Q factor correction
704: Q factor inverse correction unit
705: estimated speaker diaphragm displacement amplitude after Q factor inverse correction
901: frequency characteristic of sound source at low sound volume
902: frequency characteristic of sound source at medium sound volume
903: frequency characteristic of sound source at high sound volume

The invention claimed is:

1. An audio signal processing device comprising processing circuitry to:

perform high-pass filtering to convert an input audio signal into a first audio signal and to output the first audio signal, estimate displacement amplitude of a speaker diaphragm when the input audio signal is inputted, perform saturation processing on the displacement amplitude that is estimated or on a signal obtained by correcting the displacement amplitude, generate a second audio signal by using displacement amplitude obtained after the saturation processing, and synthesize the first audio signal and the second audio signal.

2. The audio signal processing device according to claim 1, wherein the processing circuitry estimates the displacement amplitude of the speaker diaphragm by using a resonance frequency or volume information of the speaker that reproduces the input audio signal.

3. The audio signal processing device according to claim 2, wherein the processing circuitry further performs functions to:

generate a signal obtained by adjusting the first audio signal, control a frequency characteristic of harmonics generated by the saturation processing of the displacement amplitude, and generate the second audio signal by using a signal obtained after controlling the frequency characteristic of the harmonics.

4. The audio signal processing device according to claim 3, wherein a sum of gain in a frequency characteristic to be used in adjusting the first audio signal and gain in a frequency characteristic to be used in controlling the frequency characteristics of the harmonics in a frequency domain is constant throughout a frequency band where an input audio signal exists.

5. The audio signal processing device according to claim 4, wherein the processing circuitry further performs functions to:

correct the displacement amplitude that is estimated, by using a Q factor of the speaker that reproduces the input audio signal, thereby generating a signal obtained by the correction of the displacement amplitude, correct the signal obtained after controlling the frequency characteristic of the harmonics using an inverse of a frequency characteristic with respect to a frequency characteristic in correcting the displacement amplitude that is estimated, and generate the second audio signal by using a signal obtained after the inverse correction.

6. The audio signal processing device according to claim 3, wherein the processing circuitry further performs functions to:

correct the displacement amplitude that is estimated, by using a Q factor of the speaker that reproduces the input audio signal, thereby generating a signal obtained by the correction of the displacement amplitude, correct the signal obtained after controlling the frequency characteristic of the harmonics using an inverse of a frequency characteristic with respect to a frequency characteristic in correcting the displacement amplitude that is estimated, and generate the second audio signal by using a signal obtained after the inverse correction.

7. The audio signal processing device according to claim 2, wherein the processing circuitry further performs functions to:

correct the displacement amplitude that is estimated, by using a Q factor of the speaker that reproduces the input audio signal, thereby generating a signal obtained by the correction of the displacement amplitude, correct the signal obtained after controlling the frequency characteristic of the harmonics using an inverse of a frequency characteristic with respect to a frequency characteristic in correcting the displacement amplitude that is estimated, and generate the second audio signal by using a signal obtained after the inverse correction.

8. The audio signal processing device according to claim 1, wherein the processing circuitry further performs functions to:

generate a signal obtained by adjusting the first audio signal, control a frequency characteristic of harmonics generated by the saturation processing of the displacement amplitude, and generate the second audio signal by using a signal obtained after controlling the frequency characteristic of the harmonics.

9. The audio signal processing device according to claim 8, wherein a sum of gain in a frequency characteristic to be used in adjusting the first audio signal and gain in a frequency characteristic to be used in controlling the frequency characteristics of the harmonics in a frequency domain is constant throughout a frequency band where an input audio signal exists.

10. The audio signal processing device according to claim 9, wherein the processing circuitry further performs functions to:

correct the displacement amplitude that is estimated, by using a Q factor of the speaker that reproduces the input audio signal, thereby generating a signal obtained by the correction of the displacement amplitude, correct the signal obtained after controlling the frequency characteristic of the harmonics using an inverse of a frequency characteristic with respect to a frequency characteristic in correcting the displacement amplitude that is estimated, and generate the second audio signal by using a signal obtained after the inverse correction.

11. The audio signal processing device according to claim 8, wherein the processing circuitry further performs functions to:

correct the displacement amplitude that is estimated, by using a Q factor of the speaker that reproduces the input audio signal, thereby generating a signal obtained by the correction of the displacement amplitude, correct the signal obtained after controlling the frequency characteristic of the harmonics using an inverse of a frequency characteristic with respect to a frequency characteristic in correcting the displacement amplitude that is estimated, and generate the second audio signal by using a signal obtained after the inverse correction.

12. The audio signal processing device according to claim 1, wherein the processing circuitry further performs functions to:

correct the displacement amplitude that is estimated, by using a Q factor of the speaker that reproduces the input audio signal, thereby generating a signal obtained by the correction of the displacement amplitude, correct the signal obtained after controlling the frequency characteristic of the harmonics using an inverse of a frequency characteristic with respect to a frequency characteristic in correcting the displacement amplitude that is estimated, and generate the second audio signal by using a signal obtained after the inverse correction.

* * * * *